US006308481B1

(12) United States Patent
Goldberg

(10) Patent No.: US 6,308,481 B1
(45) Date of Patent: Oct. 30, 2001

(54) COSMETIC ENHANCEMENT OF OVERPASS STRUCTURE

(76) Inventor: Jack Goldberg, 4370 W. Touhy Ave., Lincolnwood, IL (US) 60646

( * ) Notice: Subject to any disclaimer, the term of this patent is extended or adjusted under 35 U.S.C. 154(b) by 0 days.

(21) Appl. No.: 09/345,580

(22) Filed: Jun. 30, 1999

Related U.S. Application Data

(60) Provisional application No. 60/120,850, filed on Feb. 19, 1999.

(51) Int. Cl.[7] ..... E04F 13/00

(52) U.S. Cl. ..... 52/311.1; 52/738.1; 52/746.1

(58) Field of Search ..... 52/311.1, 311.3, 52/736.3, 737.4, 738.1, 519, 526, 746.1, 746.11; 14/74, 78

(56) References Cited

U.S. PATENT DOCUMENTS 3,413,775 * 12/1968 Katz ..... 52/737.4
3,590,547 * 7/1971 Molyneux et al. ..... 52/738.1
4,043,092 * 8/1977 Paul et al. ..... 52/738.1 X
4,081,941 * 4/1978 Van Ausdall ..... 542/737.4 X
4,467,584 * 8/1984 Crites et al. ..... 52/737.4
4,672,781 * 6/1987 Pichon ..... 52/94
4,958,476 * 9/1990 Kotter ..... 52/738.1 X
5,077,949 * 1/1992 Kotter ..... 52/738.1 X
5,548,940 * 8/1996 Baldock ..... 52/518 X
5,584,150 * 12/1996 Newman ..... 52/738.1 X
6,122,878 * 9/2000 Pliley ..... 52/746.1 X

* cited by examiner

*Primary Examiner*—Carl D. Friedman
*Assistant Examiner*—Christopher T. Kent

(57) ABSTRACT

The invention provides for a system, method and components adapted for the cosmetic enhancement of overpass structures, said system comprising plastic sheeting adapted for attachment to overpass structures. The method comprising attaching plastic sheeting adapted for covering overpass structures to the overpass by way of suitable attaching means, and the plastic sheets being adapted for such use.

6 Claims, 5 Drawing Sheets

COSMETIC ENHANCEMENT OF OVERPASS STRUCTURE

PRIOR APPLICATIONS

This application claims priority to copending U.S. Provisional Application For Patent Ser. No. 60/120,850 filed Feb. 19, 1999.

FIELD OF THE INVENTION

This invention is directed towards methods and materials useful in enhancing the cosmetic appearance of overpass structures, and a system and kit for accomplishing such.

BACKGROUND OF THE INVENTION

Public funding for roadway improvements and infrastructure repairs and maintenance have fallen well below levels needed to keep up with the steadily deteriorating conditions of the public roadways in the United States. Roadway deterioration of structural components of overpass structures are most commonly treated with temporary or convenient repairs that shore-up the structural integrity of the overpass, but leaves much to be desired as to cosmetic appearance. Damage to roadway overpasses occurs both structurally and cosmetically where peeling paint and visible rusting create eyesores which are both aesthetically undesirable, and gives the public tax-payer negative feed-back as to the use of hard-earned tax dollars.

Similarly, many railroad bridges are in a state of disrepair and cosmetic deterioration, some crossing over roadways, or spanning barriers such that these cosmetic imperfections are viewable by observers in their vicinity.

This is most apparent to anyone who has driven on roadways and has seen the deterioration and dirt under roadway overpass structures. While cosmetic deterioration such as dirt, bird droppings, peeling and discolored paint, graffiti, and surface rust do not significantly effect the structural integrity of overpasses, such cosmetic blemishes cause psychological harm and assault aesthetic sensibilities. The basic construction of bridges and roads are described briefly in, for example, Lapinski, Michael A., *Road and Bridge Construction Handbook,* Van Nostrand Reinhold Co., New York, N.Y., 1978).

A simple and cost-effective method of cosmetically disguising peeling paint, surface rust spots, or structural repairs would be useful and help reduce the overall cost of cosmetic maintenance of roadway overpass structures.

For several years, plastic based siding has been commercially available for cladding homes. (See for example Alth, Max, *Do-it-yourself Roofing and Siding,* Hawthorne Books, Inc., New York, N.Y., 1977, Chps. 8 & 99; and Dietz, Albert G. H., *Dwelling House Construction,* 4th ed., The MIT Press, Cambridge, Mass., 1974, pp. 234–8). Typically plastic or vinyl siding is made of pvc, pva or other suitable polymer or copolymer, which can be obtained from virgin synthetic material or recycled plastics. Suitable plastics include, but are not limited to, thermoplastic resins such as ABS, acetals, acrylics, acrylonitrile-based resins, cellulosics, fluorocarbons, phenylene oxide based resins, polyallomers, polyamides, polyaryl ether, polyaryl sulfone, polybutylene, polycarbonates, polyester, polyethylene, polyimides, polyphenylene sulfide, polypropylenes, polystyrene, polysulfone, and vinyls, or thermosetting resins such as alkyds, allylics, epoxies, melamines, phenolics, polyesters, silicones, and ureas.

Plastics suitable for use in the present invention, and methods of manufacture and manipulation of such are known in the art, and can be found described in, for example, *Plastics Engineering Handbook of the Society of the Plastics Industry, Inc.,* (4th ed., ed. Joel Frados, VanNostrand Reinhold Co., Chicago, 1976). Plastics have long become a large component of the home construction industry (see for example Dietz, Albert G. H., *Dwelling House Construction,* 4th ed., The MIT Press, Cambridge, Mass., 1974, Chapter 16), and are well suited for use in public works projects. Plastics can be enhanced with chemical additives to inhibit the adherence of paints, inks and the like to the surface of these plastics. This can serve as a useful deterrent to graffiti and other forms of vandalism or defacing. In addition to being a suitable material, the incorporation of recycled plastics from consumer packaging into the siding of the invention will provide added benefits to the environment as a whole.

The use of plastic cladding, adapted for attachment to roadway or railway overpass support structures, in a system of this invention is a useful and cost-effective means of cosmetically enhancing the appearance of public roadways.

BRIEF SUMMARY OF THE INVENTION

The invention encompasses a method for cosmetically enhancing the appearance of overpass structures, said method comprising the steps of affixing a plastic sheet to the exposed surfaces of said overpass wherein said plastic sheet is molded to removable attach to said surface. The invention encompasses a system of covering an overpass structure comprising plastic sheet segments adapted for attachment to the overpass structure. The invention provides for kits comprising plastic sheets and attachment means, apparatus or devices such as adhesives, glues, staples, bolts, screws, nails, hooks, clamps, clips, or snaps and the like; and also for ancillary components such as bushings, washers, spacers, corner pieces, endpieces and the like, for practicing the method of the invention using the system of the invention.

In a preferred embodiment of the invention, the plastic sheets are extruded and/or molded in segments which when fitted together form a relatively uniform continuous surface. It is preferred that the plastic sheets of the invention be adapted for attachment to overpass structures.

The plastic sheet segments of the invention can be reversibly affixed to overpass support structures using any number of attachment means, including nails, staples, screws, bolts, hooks, clips, clamps, snaps, buckles, straps, wires, glues, and other suitable adhesives.

In a preferred embodiment, the system of the invention provides multiple plastic sheets, adapted for attachment to overpass structures, which interlock with each other to form a flexible continuous covering segment over an exposed surface of an overpass. The system of the invention provides for suitable attachment means including anchors, such as for example bolts, screws, nails, or spikes, and optionally adhesives. In a preferred embodiment, the system of the invention provides plastic sheeting adapted for attachment to overpass structures by having suitably placed and suitably strengthened attachment points on the body of the sheets. Such attachment points may accept clips, adhesives, or used for securing bolts, screws, nails or the like with the plastic sheet to the overpass structure. In a preferred embodiment, the attachment points allow for fixing the sheets to the structure and allow for suitable accommodation of the thermal expansion and contraction of the plastic sheet.

In a preferred embodiment, a first anchor sheet can be semi-permanently attached to said overpass structure such that subsequent sheets, formed to interlock with each other, will become semi-permanently anchored to the previously attached sheet via suitably interlocking molded structures on the sheets themselves, followed by anchoring of the remaining free ends to the support overpass via clips, nails or screws that are semi-permanently or permanently attached to the overpass structure. The anchoring of the free end can occur prior to, or after positioning the next interlocking sheet in series.

The invention provides for plastic sheet and ancillary cladding components which have been adapted for attachment to overpass structures. This adaptation comprising integrated attachment points which allow for reversibly fixing siding sheets to structures using suitable attaching means such as including nails, staples, screws, bolts, hooks, clips, clamps, snaps, buckles, straps, wires, glues, and other suitable adhesives. In particular, the invention provides for plastic sheet extruded and/or molded to be fitted over and within the side of a typical steel I-beam. Such "fitted" plastic sheets are either "half" or "full" in that two "half" sheets would cover both sides and the bottom of an I-beam, the seam being a the bottom of the exposed I-beam, or "full" in that the plastic sheet is molded to slip over the entire exposed I-beam, with no seam on the bottom of the I-beam. This "full" sheet may optionally have tapered or straight sides, instead of a form-fitting concavity.

One other preferred conformation of the plastic sheets of the invention is in the size of the sheets. Typical vinyl siding are extruded as single 8" width or double 4" width panels. For use in covering larger expanses of exposed surface, as in along the wingwalls, or abutment backwalls of the overpass structure, plastic sheets with larger width dimensions are contemplated. Sheets that are up to about 48" in width could be made for covering large surfaces quickly. The size of these plastic sheets will depend upon the availability of manufacturing equipment, and the tensile strength of the sheet plastic to resist cracking when made up in large sheets.

The present invention provides for an overpass structure, covered with plastic sheets according to the method of the invention. A preferred embodiment is an overpass structure being covered by a multiplicity of more than one semi-rigid plastic sheathing, removably fixed to the overpass structure. In one preferred embodiment, the plastic sheathing are sheets that have been adapted for attachment to the overpass structure, as in being molded/shaped/extruded to conform closely to the shape of the surface to be covered. An additional embodiment of the invention further comprises plastic sheets that have been covered, painted or integrally molded with decorative or informational designs.

BRIEF DESCRIPTION OF THE DRAWINGS

The invention, in many of its aspects and embodiments, may be better understood in view of the following drawings in which:

FIG. 2E shows the sheet (5) covering the entire beam/stringer (4) with straight sided formed sheet.

FIG. 2F shows two sheets (5) each covering half the beam/stringer (4) and joined by a seam at the bottom (9).

DETAILED DESCRIPTION OF THE INVENTION

Purpose

Figure 1A:
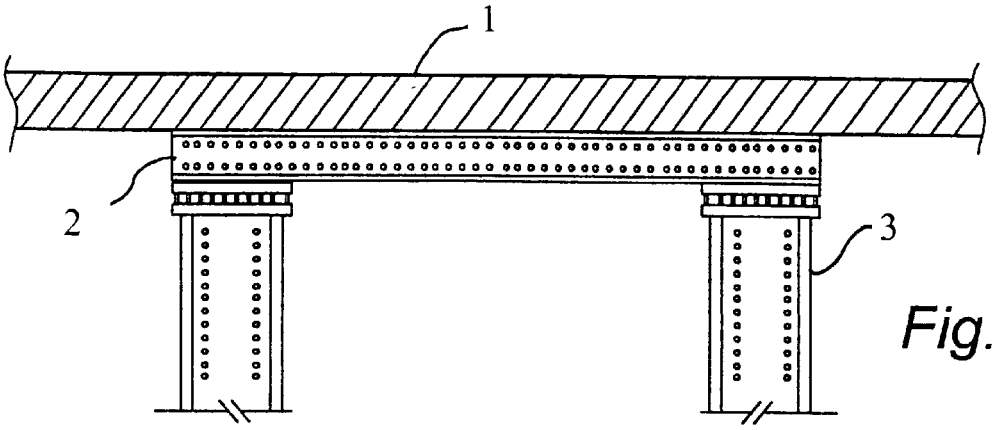
FIG. 1A is a drawing showing the front elevation plan of a representative overpass structure, showing supported structure (1), exposed beam/stringer in side view (2), and supports (3).

The purpose of the present invention is to provide a system for cosmetically enhancing the appearance of overpass structures. The system provides for the reversible application of sections of plastic sheeting to the overpass support structures, such that the sheeting provides a cosmetically enhanced appearance that will conceal or otherwise over shadow the generally oxidized, rusted, peeling-paint appearance commonly found.

The method of the invention comprises attaching plastic sheets to the surface of an overpass structure, using suitable attachment means. In a preferred embodiment, the plastic sheets are adapted for attachment to the overpass, and are interlocking so as once in place, to form a continuous flexible covering over at least a segment of the overpass.

Thus the invention provides for plastic sheathing/covering sheets and ancillary parts adapted for attachment to overpass structures. The invention provides for a kit comprising plastic sheets adapted for attachment to an overpass structure, and, for attachment means. The invention further encompasses an overpass structure, wherein said overpass structure is reversibly covered with more than one plastic sheathing sheet, preferably attached so as to allow for some flexibility in the sheet due to thermal expansion or contraction.

Overpass Support Structures

As illustrated in FIG. 1, a typical overpass support structure consists of any number of steel support beams and concrete supports which will span a roadway, walkway, railway or other such space passing beneath the overpass. The steel support beams can be supported by any number of bracing members which, while not supporting any weight, act to support the rigidity of the steel support beams in response to lateral movement and stress. These support structures, and most importantly their exposed surfaces, are typically painted surfaces which are subject to weathering and oxidation. Re-painting and repair of rusting can, depending on the level of government spending, be neglected for several years. The cosmetic coverings of the present invention can be further useful in helping to reduce the impact of weather on the deterioration of the structural surfaces, along with enhancing the esthetic appearance of the structures.

Structure of Sheets

The plastic coverings envisioned for use in the present invention are rigid or semi-rigid plastics which will allow for application and covering of the overpass support structures, yet are still strong enough to resist tearing or physical damage from impacts and other forms of physical stress. For example, suitable thicknesses will be similar to those found in use for preparing siding or lathes for use in sheathing homes. Rigid sheeting will maintain its linear shape with some bending, however it will not be pliable so as the opposing ends down the length of an 8 to 15 foot sheet can be brought into contact without breaking. Semi-rigid sheets would be pliable without cracking or breaking, such that an 8 to 15 foot sheet could be bent so that opposing ends along the length could be brought into contact without cracking or breaking the sheet.

A preferred plastic sheet of the invention adapted for use in covering an overpass structure can have a thickness dimension from about 0.025 to 0.75 inches or more, and dispersed along said length dimension are a multiplicity of attachment points for fixing said sheet to a surface. In a more preferred embodiment, a plastic sheet of the invention may have a thickness dimension of from about 0.1 to 0.5 inches. It is contemplated that the actual thickness of the plastic sheets will depend upon several variables, including, strength desired to resist punctures, location to be attached, and source of plastic. For example, in use under highway settings where high speeds and stone impacts can be expected, thicker sheets may be called for. In locations with limited traffic, such as pedestrian walkways, thinner sheets can be used. Depending upon the length of expanse to be covered, thicker/heavier sheets may provide more structure rigidity to allow for the expanse to be covered with fewer sheets. Plastic from recycled consumer goods are suitable for use in such sheets, but may require use in thicker sheets than other virgin plastics.

The present invention envisions sheets that are generally planar in shape, having a width that is not beyond the limit of the stress capacity of the sheet, so that the sheet will not induce cracking around fasteners or attachment points. In many cases, similar overpass structures can be found on the same length of roadway, which will allow for the custom molding and repeated use of shaped sheets that can be applied to specific angular or otherwise non-linear portions of the overpass structural elements. The structural sheets can be molded or extruded and subsequently shaped to accept hanging bracket hardware, or to interlock with adjacent sheets. In general, it is most desired that the sheeting fit together so as to present an almost seamless uniform sheet on its face. However, overlapping sheets, such as found with house siding is also acceptable. Typically, the sheets can be approximately 8 to 15 feet in length, and having a width of from 4 inches to 24 inches. Greater widths, up to 48 inches are possible, however they will be more difficult to attach and use. Shorter and longer lengths are all contemplated, but longer sheets may require the blockage of large sections of roadway to complete attachment.

As an adaptation for use in the methods of the invention, supporting members can be integrated in the sheet so as to provide rigid support for attachment points such as clamping locations, bolt pass through anchor points, or glue attachment locations. Thus individual sheets need not be overly thick, and still possess the properties of being attachable to the desired surface without frequent stress related cracking or breaking of the sheet structure. Typical house siding has a continuous perforated flange running along the length of the sheet, for ease of attaching the sheet using nails. For the present invention, the plastic sheets are preferably adapted for attachment to overpass structure, and are provided more rigidity by reducing the number of perforations such that they do not run continuously along the edge.

It is envisioned that the lengths of the sheets would be preferred to be less than the width of one lane of traffic (approximately 8–15 feet) as this will facilitate the application of the sheets of overpass structures of roadways while open to traffic in adjacent lanes. However, as needed, longer or shorter sheets are also suitable.

The invention provides for plastic sheet and ancillary cladding components extruded and/or molded to be fitted over and within the side of a typical steel I-beam. Such I-beam stringers are typically the most exposed surface underneath the roadway/railway supported by the overpass, and usually the most deteriorated appearance wise. Such "fitted" plastic sheets are either "half" or "full" in that two "half" sheets would cover both sides and the bottom of an I-beam, the seam being a the bottom of the exposed I-beam, or "full" in that the plastic sheet is molded to slip over the entire exposed I-beam, with no seam on the bottom of the I-beam. This "full" sheet may optionally have tapered or straight sides, instead of a form-fitting concavity. Concrete stringers, posts and walls are more easily covered as they are usually formed with mostly planar surfaces.

The structure of the plastic sheets can be molded so as to accommodate interconnection between adjacent sheets, such as by means of tongue and groove joints, or fitting an edge into an adjoining notch. Thus, a plastic sheet of the invention can have one edge of said sheet notched, and the opposite end un-notched, such that the notched end of a first sheet can be fitted within the un-notched end of a second adjacent sheet when placed into contact. This joint is preferably flexible and deep enough so as to allow for some expansion and contraction of the sheets due to weather. Where it is desired to have blunt end and sided sheets used, either for ease of manufacture or installation, such blunt sides placed into contact can be suitably reinforced by the use of notch and biscuit type fittings between the sheets. The notches can be suitably cut into the side of the sheets, and biscuits made from appropriate plastic, rubber or metal can be fitted in place. The biscuit may be optionally fixed to either one or both adjoining sheets.

Attachment

Attachment of the sheets to the overpass structure can be accomplished with any number of glues or fasteners. However, it is most preferred that the sheets be reversibly fastened to the overpass structure, so as to facilitate repair and maintenance of the overpass support elements. However, as the cost of the sheet elements may not be that great, it is envisioned that the sheets can be one-use disposable elements. Thus the use of adhesives, which can fixably mount the plastic sheets to the surface of the overpass is also envisioned. Either mounting method will have certain advantages and disadvantages.

Attachment by fasteners will require more complicated initial installation, but may greatly reduce the cost of replacement or maintenance. Attachment with adhesives will greatly facilitate initial installation, but will make repair or replacement more difficult, most likely requiring the sanding removal of residual adhesive before application of a replacement panel. Regardless of the attachment means, a system of the invention will provide suitable sheets of plastic for use to covering an overpass structure to be used with either adhesive or other attachment means.

However, recognizing and identifying the thermal expansion and contraction properties of the specific plastic material used to manufacture the sheets, accommodation for this variability is built in to the attachment points and attaching means. For example, rigidly reinforced attachment points having a channel bored through to allow for the insertion of a bolt, hook, nail, screw or the like, can be designed with a diameter slightly larger than that of the inserted attaching means. To create more firmly fixed attachment, bushings made from rubber or any other suitably pliable and resilient material can be installed within the channels. Similarly, washers made from rubber or such material can be used to cushion the attachment of the attaching means to the plastic sheet.

Any adhesive or glue used as an attaching means should be chosen for the ability to maintain flexibility under extreme cold. However, accommodation of adhesives can be made by the use of bushings. These bushings are made of rubber or other suitable material, and are glued or otherwise attached to one or both surfaces, thus providing flexibility for accommodating thermal induced movements of the sheets. Thus, the attachment of the plastic sheets to the surface can make proper accommodation for the thermal properties of the sheet.

Maintenance

Cosmetic sheeting of the present invention can be routinely maintained by the occasional rinsing with water or soapy water, such as done with home siding. The replacement of broken or cracked sheets can be accomplished by the removal of one or more adjacent sheets, allowing access to and removal of the damaged sheet. If desired, plastic sheeting may be painted with a suitable paint.

Applied Designs

Where appropriate, as dictated by traffic safety concerns, the surface of the covering sheets of the invention can be further decorated with applied images or designs to further enhance the esthetic appeal. In addition to decorative designs, overpass structures can be easily decorated with informative signs, road markings or other forms of information for travelers, or with advertisements for public service announcements or even commercial products or services. The applied decorative designs can be permanently molded or otherwise cast into the sheets such that when properly applied they reform the message. Alternatively, the applied decorative designs can be printed on resilient sheeting that can be permanently or semi-permanently attached to the covering sheets.

Thus, like attaching billboard signs to busses or building walls, the resilient sheeting can be attached to the surface of the plastic sheeting.

Safety Features

One contemplated modification of the sheeting of the invention would reduce the damage from impact collisions with overpass walls. Layers of foam or other suitable resilient materials can be layered beneath the plastic sheeting lining the walls of overpass structures. The resilient material would then absorb some of the energy from an impact collision, and help to reduce the damage due to such impact to both the overpass structure and the impacting object.

The plastic sheeting of the invention could be applied over an additional steel impact cage. This steel impact cage being designed to collapse upon impact collision, and to absorb kinetic energy from the impact.

EXAMPLES

As depicted in FIG. 1A the front elevation plan of a representative overpass structure, showing supported structure (1), exposed beam/stringer in side view (2), and supports (3) will over time exhibit peeling paint, rusting, and other blemishes to its exposed surfaces and around rivets. Typically, as depicted in FIG. 1B the side elevation plan of a representative overpass structure will have a series of stringers (4), between the supports (3), upon which rests additional steelwork and finally the supported structure (1) which comprises the road/rail bed, and typically along the side of the supported roadway/railway, there is usually a wall/barrier so as to prevent falling off the overpass to the ground below.

Figure 1B:
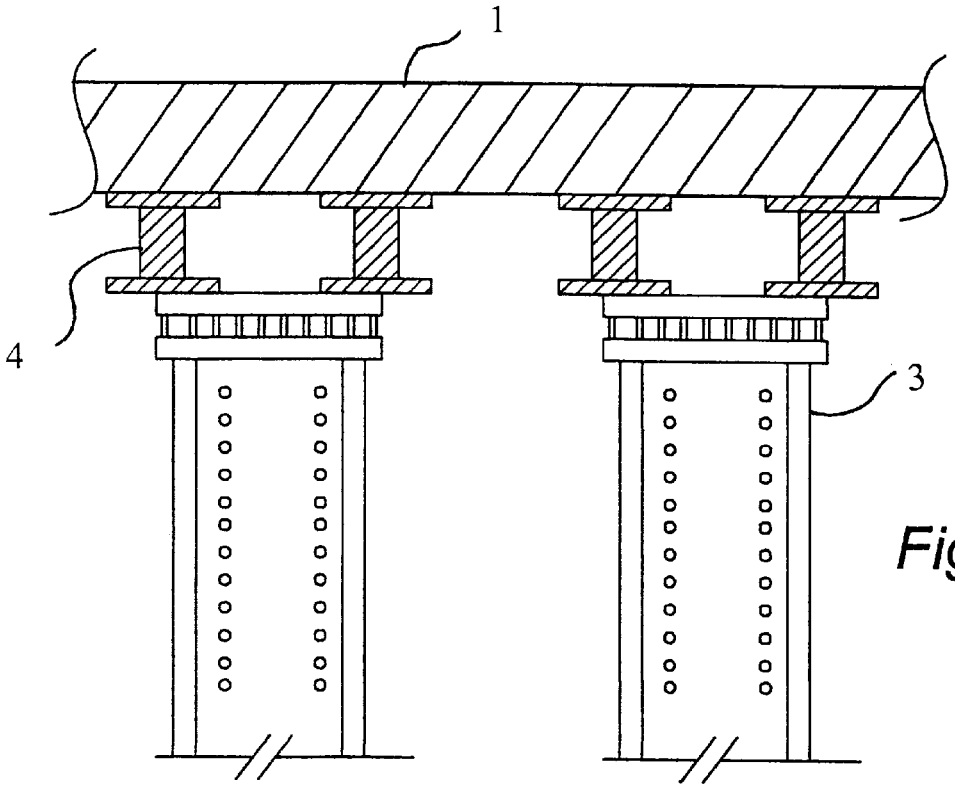
FIG. 1B is a drawing showing the side elevation plan of a representative overpass structure, showing supported structure (1), exposed beams/stringers in cross-section (4), and supports (3).
Figure 2A:
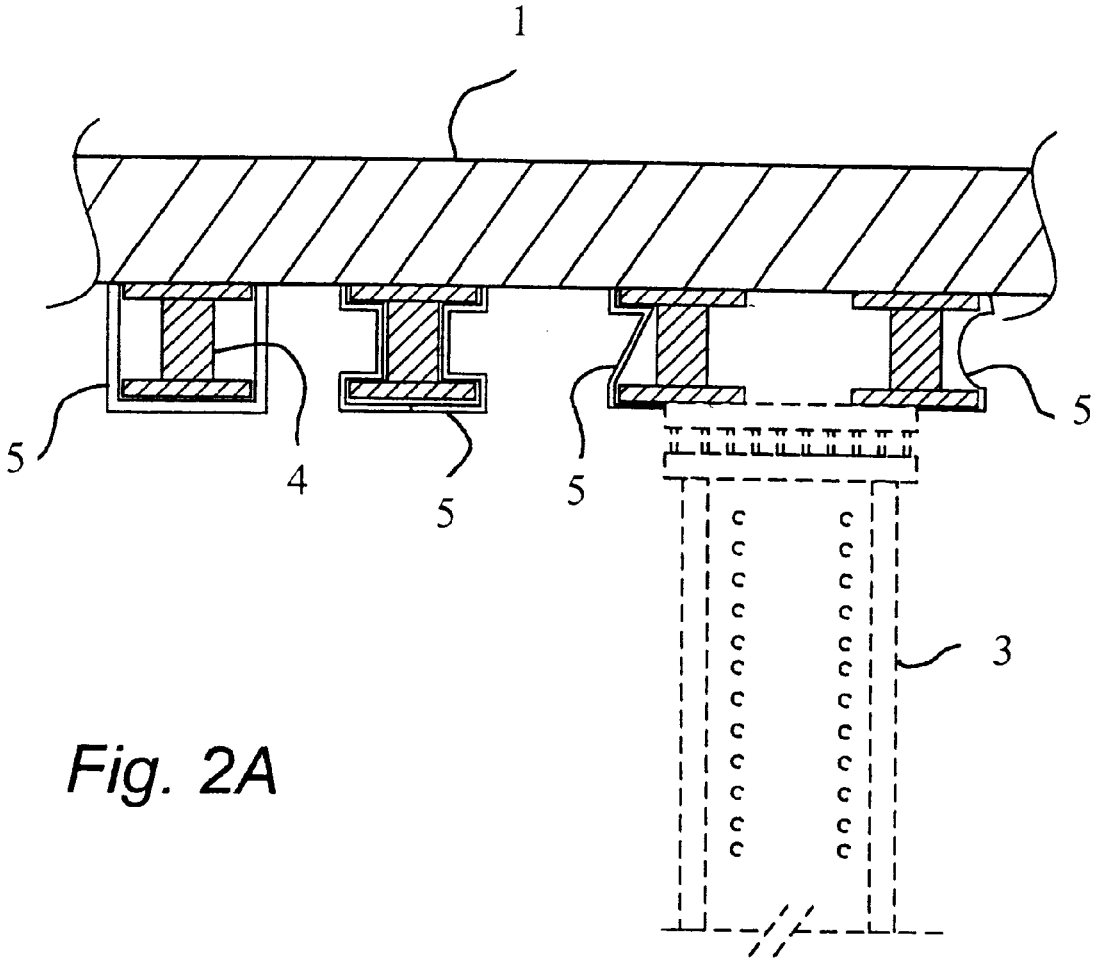
FIG. 2A is a drawing of a view similar to FIG. 1B, showing supported structure (1), beams/stringers in cross-section (4), and supports (3), with various embodiments of the cosmetic enhancement of the invention (5) shown covering the beams/stringers (4) in close fitting conformations.

FIG. 2A, is a drawing of a view similar to FIG. 1B, showing supported structure (1), beams/stringers in cross-section (4), and supports (3), with various embodiments of the cosmetic enhancement of the invention (5) shown covering the beams/stringers (4) in close fitting conformations. The covering sheets of the invention are depicted here as being form fitting, or closely fitting to the exposed I-beam/stringer (4). The supports (3) also have a similar I-beam shape, which is not depicted here, and can be covered in a similar form fitting manner.

Figure 2B:
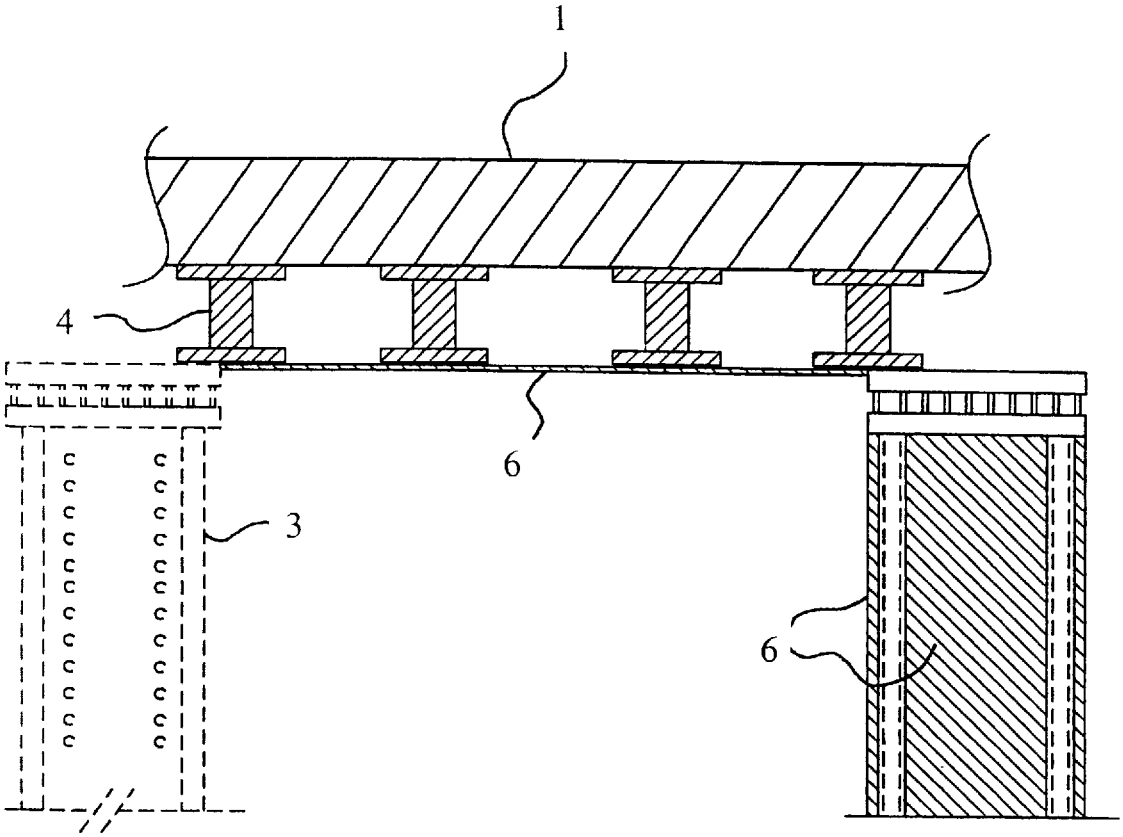
FIG. 2B is a drawing of a view similar to FIG. 1B, showing supported structure (1), beams/stringers in cross-section (4), and supports (3), with the cosmetic enhancement sheets of the invention (6) shown covering the beams/stringers (4) and supports (3).
Figure 2C:
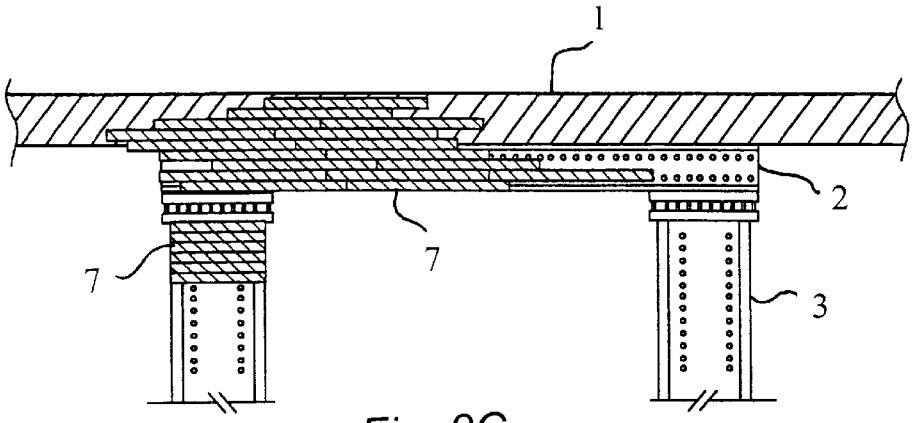
FIG. 2C is a drawing of a view similar to FIG. 1A, showing supported structure (1), beam/stringer in side view (2), and supports (3), with the cosmetic enhancement sheets of the invention fixed to the structure as small sheets (7).
Figure 2D:
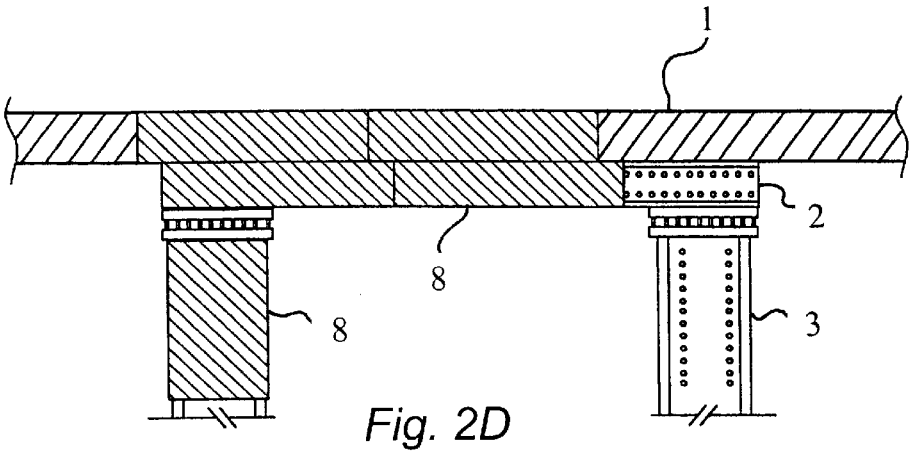
FIG. 2D is a drawing of a view similar to FIG. 1A, showing supported structure (1), beam/stringer in side view (2), and supports (3), with the cosmetic enhancement sheets of the invention fixed to the structure as large sheets (8).
Figures 2E, 2F, 2G, 2H, 2I:
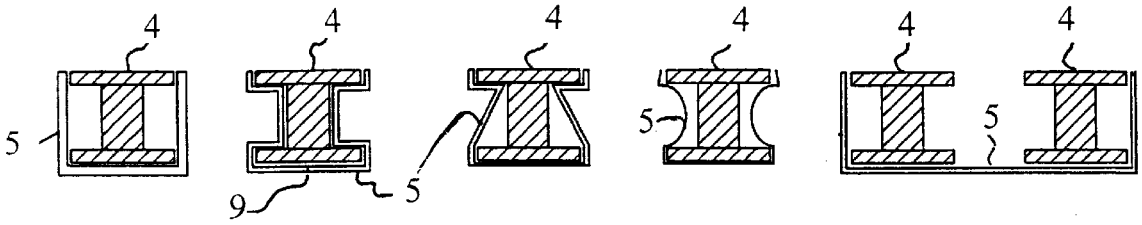
FIGS. 2E–F illustrate various embodiments of the cosmetic enhancement sheets (5) of the invention covering I-Beam/stringer shown in cross-section (4).
FIG. 2G depicts a tapered side configuration for the sheet (5) which can be a single sheet or two sheets joined at the bottom.
FIG. 2H depicts a concave side configuration for the sheet (5) which can be a single sheet or two sheets joined at the bottom.
FIG. 2I shows that the sheets may cover two or more beams/stringers (4), depending upon the installation conditions.

Alternatively, as shown in FIG. 2B the cosmetic enhancement sheets of the invention (6) can be spread as large sheets to cover the beams/stringers (4) and supports (3). The covering sheets can be, as described above, of various dimensions. When covering the overpass structure, following normal practice, seams are typically overlapped. As shown in FIG. 2C small sheets (7) can be used, or as shown in FIG. 2D larger sheets (8). The sheets shown in FIGS. 2C and 2D may be flat sheets, or optionally may actually have the conformation of a form fitting sheets, as depicted in FIGS. 2E through 2I. Any combination of flat, form fitting, or the like can be used to cover a structure. The alternative form fitting configurations are advantageous for rainwater run-off, or to keep birds from perching.

Figure 3A:
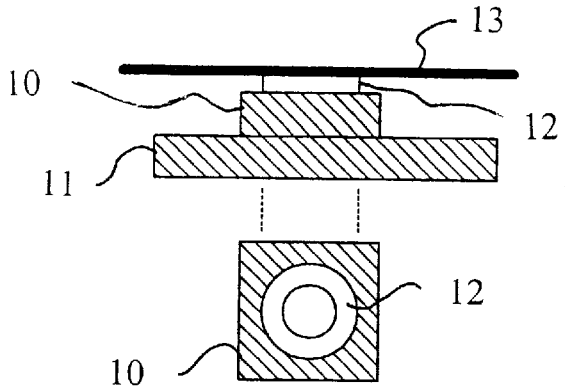
FIG. 3A depicts one envisioned attachment point (10), integrally molded or attached to the sheet (11), and having within a hole drilled into (or optionally through) the attachment point, a bushing (12) made of a resilient material, allowing for flexible attachment of the sheet to the surface to be covered (13).

As shown in FIG. 3A one envisioned attachment point (10), integrally molded or attached to the sheet (11), and having within a hole drilled into (or optionally through) the attachment point, a bushing (12) made of a resilient material, allowing for flexible attachment of the sheet to the surface to be covered (13). The bushing can be fitted within the hole, and either have a portion extending beyond the surface, or a separate washer can be used to cushing the attachment between the sheet and surface to be covered.

Figure 3B:
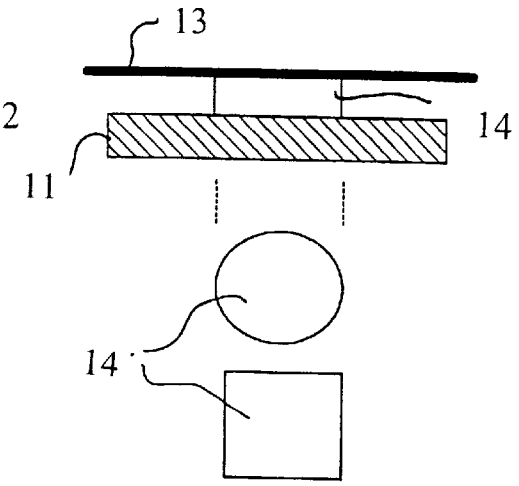
FIG. 3B depicts another envisioned attachment point that is a bushing (14) of a resilient material that is affixed by adhesive to the sheet (11) and the surface to be covered (13). This bushing can be of any suitable shape, round and square are depicted as an example.

FIG. 3B depicts another envisioned attachment point that is a bushing (14) of a resilient material that is affixed by adhesive to the sheet (11) and the surface to be covered (13). This bushing can be of any suitable shape, round and square are depicted as an example. Alternatively, the bushing can be fixed to one surface by a screw or other attachment means, then separately glued to the other surface. Thus his embodiment acts as a bushing and washer at the same time without using a rigid attachment point on the sheet.

Figure 3C:
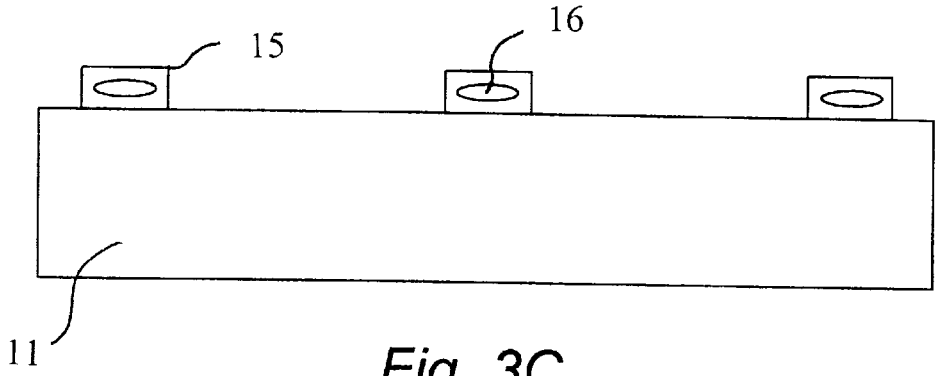
FIG. 3C depicts a sheet of the invention (11) in a top view, with attachment points (15) along a long edge of the sheet, each having a hole (16) for fixing to the surface to be covered with nails, hooks, screws, bolts, etc.
Figure 3D:
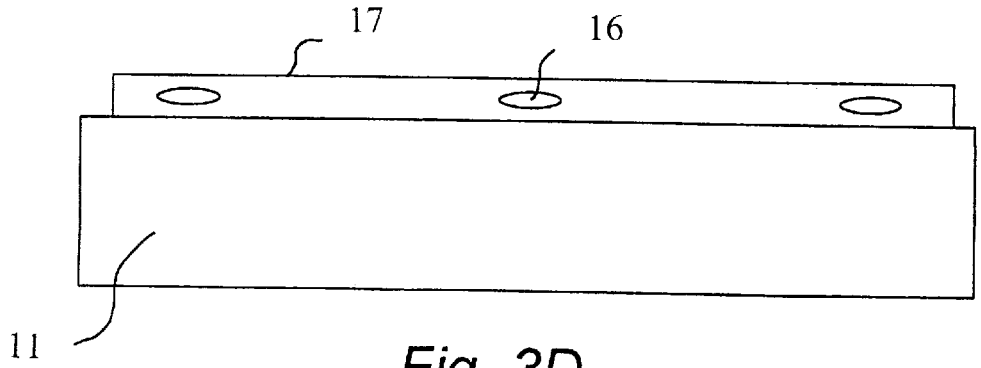
FIG. 3D depicts a sheet of the invention (11) in a top view, with a long attachment edge (17) along a long edge of the sheet, having multiple holes (16) for fixing to the surface to be covered with nails, hooks, screws, bolts, etc.

One overall configuration of the sheets of the invention, adapted for attachment to an overpass, and for interlocking with adjacent sheets is shown in FIG. 3C, which depicts a sheet of the invention (11) in a top view, with attachment points (15) along a long edge of the sheet, each having a hole (16) for fixing to the surface to be covered with nails, hooks, screws, clips, bolts, etc. Attachment points, such as shown in FIGS. 3A and 3B can be dispersed along the edges or even central portion of the sheet, if extra supportive attachment to the structure is called for. The edge configuration can also be continuous, and FIG. 3D depicts a sheet of the invention (11) in a top view, with a long attachment edge (17) along a long edge of the sheet, having multiple holes (16) for fixing to the surface to be covered with nails, hooks, clips, screws, bolts, etc.

Simplicity of manufacture, ease of installation, the requirements for the strength of attachment, and considerations of the thermal effects of weather on the sheets will dictate the optimal combination of sheet size, attachment point locations, attachment means and sheet shapes to be used for any particular overpass structure. Once a pattern of materials are coordinated for a particular overpass structure, such a pattern is suitable for use in covering similar overpass structures elsewhere.

The foregoing is intended to be illustrative of the present invention, but not limiting. Having elucidated the important considerations and characteristics, as discussed above, the materials and methods needed for preparing a suitably adapted covering of the invention, to any particular overpass structure are readily understood from the foregoing discussion. Numerous variations and modifications may be effected without departing from the true spirit and scope of the invention.

What is claimed is:

1. An overpass structure, wherein the appearance of said overpass is enhanced by reversibly affixing to a portion of the exposed surface of said overpass structure more than one plastic sheet such that the cosmetic appearance of said overpass structure is enhanced.

2. An overpass structure as in claim 1, where said sheets are decorated.

3. An overpass structure as in claim 2, wherein said decorations provide information to the observer.

4. An overpass structure as in claim 2 wherein said decoration is molded or cast within the plastic sheets.

5. A method for enhancing the cosmetic appearance of an overpass structure, said method comprising affixing planar plastic sheeting to the exposed surface of an overpass structure such that the sheeting is reversibly fixed, wherein the sheeting covers the overpass structure such that the cosmetic appearance of the overpass structure is enhanced.

6. A method as in claim 5, wherein said sheeting is decorated.

* * * * *